United States Patent [19]

Olsgaard

[11] 4,274,327

[45] Jun. 23, 1981

[54] EXPANSIBLE CHAMBER DEVICE

[76] Inventor: Orin J. Olsgaard, 527 Ford, Missoula, Mont. 59801

[21] Appl. No.: 12,610

[22] Filed: Feb. 16, 1979

[51] Int. Cl.[3] ..... F01B 15/00; F01L 17/00

[52] U.S. Cl. ..... 91/196; 91/276; 91/327; 91/402; 92/31; 417/457; 417/460

[58] Field of Search ..... 91/276, 327, 216 B, 91/217, 196; 417/457, 460; 92/32, 31

[56] References Cited

U.S. PATENT DOCUMENTS

| | | | |
|---|---|---|---|
| 148,393 | 3/1874 | White | 91/276 |
| 630,977 | 8/1899 | Emgarth | 91/327 |
| 660,681 | 10/1900 | Emgarth | 91/327 |
| 1,456,976 | 5/1923 | Gaune . | |
| 1,925,754 | 9/1933 | Hagan . | |
| 1,951,428 | 3/1934 | Mackinly | 91/327 |
| 2,317,167 | 4/1943 | Baer . | |
| 2,335,252 | 11/1943 | Appemon . | |
| 2,449,832 | 9/1948 | Bancroft | 91/276 |
| 3,188,805 | 6/1965 | Gahagon . | |
| 3,669,571 | 6/1972 | Benaroya . | |
| 3,710,767 | 1/1973 | Smith . | |
| 3,835,824 | 9/1974 | MacDonald . | |

OTHER PUBLICATIONS

Mechanical Appliances and Novelties of Construction by Hiscox, published by Norman W. Henley Publishing Co.—1917, Article 291.

*Primary Examiner*—Paul E. Maslousky
*Attorney, Agent, or Firm*—Wells, St. John & Roberts

[57] ABSTRACT

An internal combustion engine, a fluid motor or a pump includes a cylinder block enclosing an elongated cylindrical bore. A double headed piston is slidably mounted within the bore. The piston and cylinder block are rotatable relative to each other about the longitudinal axis of the bore. Rotation is imparted by a sinusoidal cam and a cam follower. Reciprocation of the piston within the bore is accomplished along with corresponding rotational movement of the cylinder block. Opposed ends of the cylinder block include openings which are aligned with and periodically communicate with exhaust and intake chambers. Porting collars are slidably mounted to the cylinder block and are stationary relative to the cylinder.

19 Claims, 24 Drawing Figures

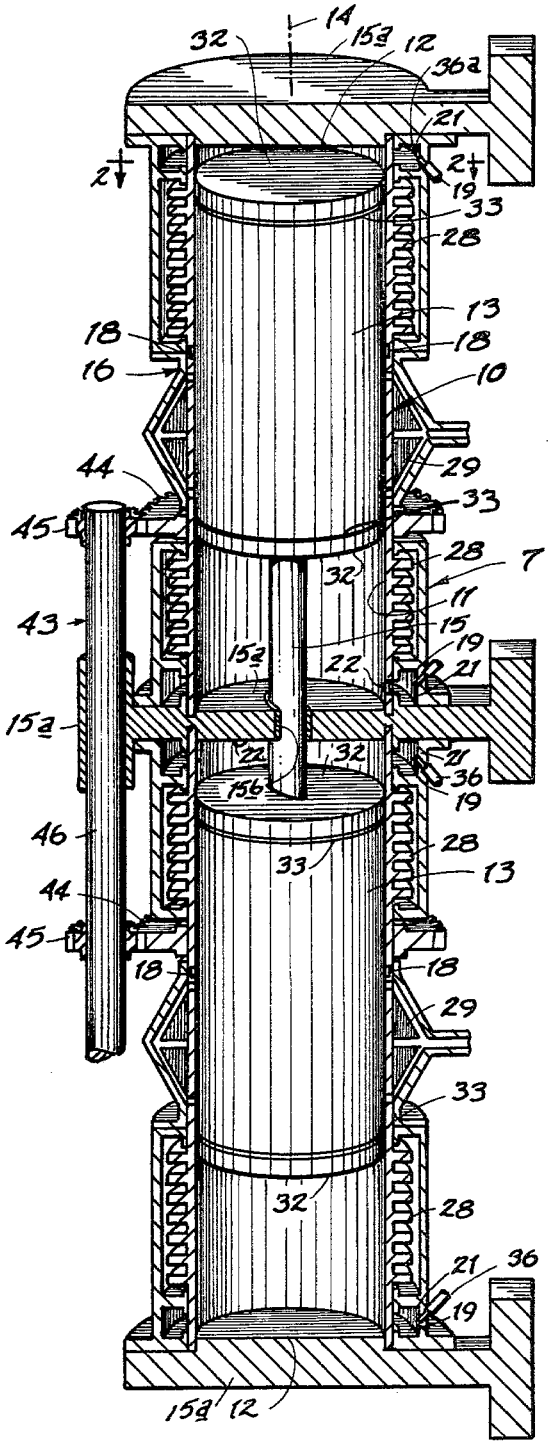
Fig 1
Fig 2
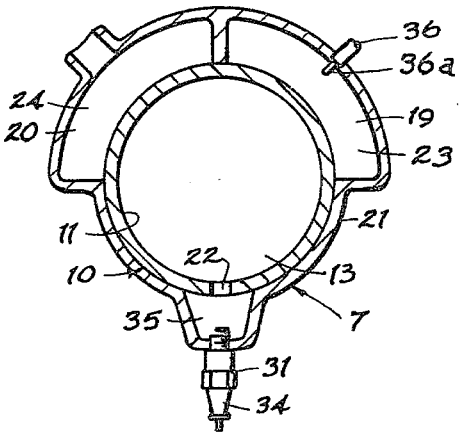
Fig 5
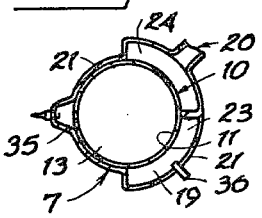
Fig 3
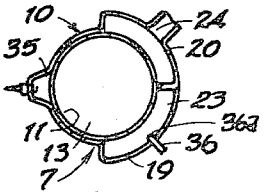
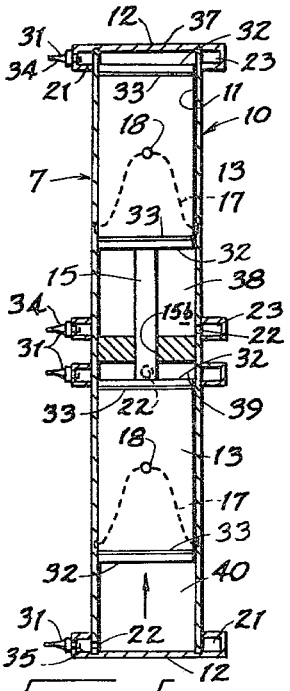
Fig 6
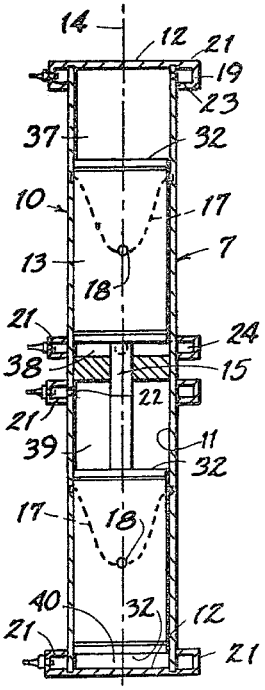
Fig 4

Fig 7
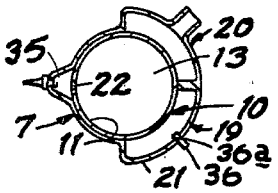
Fig 9
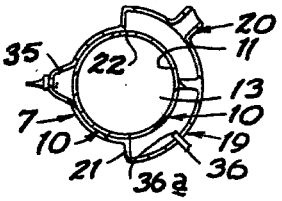
Fig 8
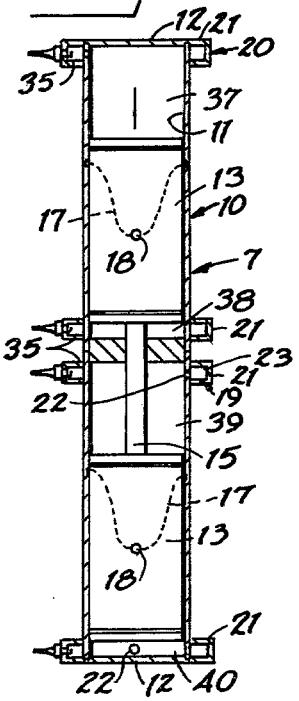
Fig 10
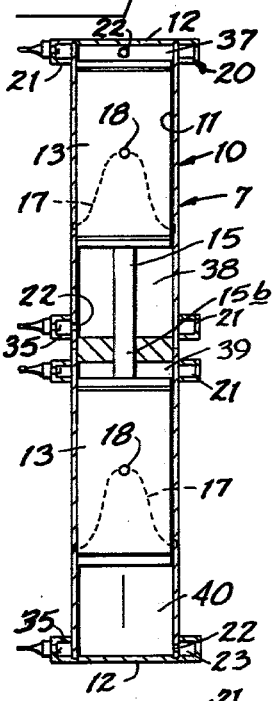
Fig 11
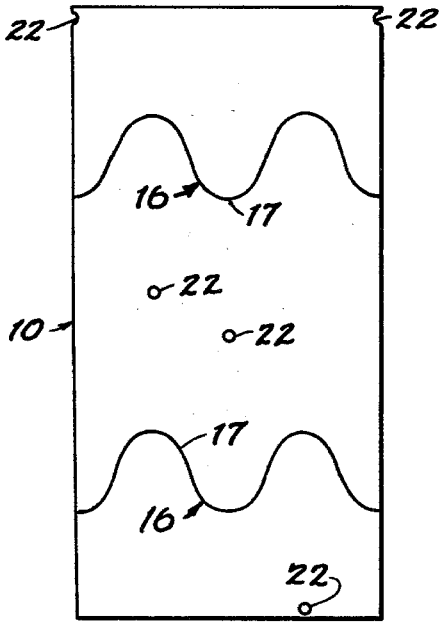
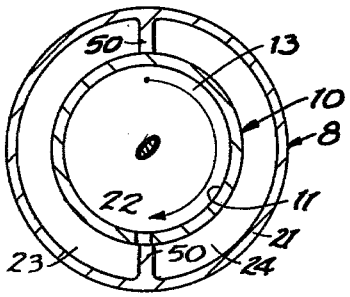
Fig 12
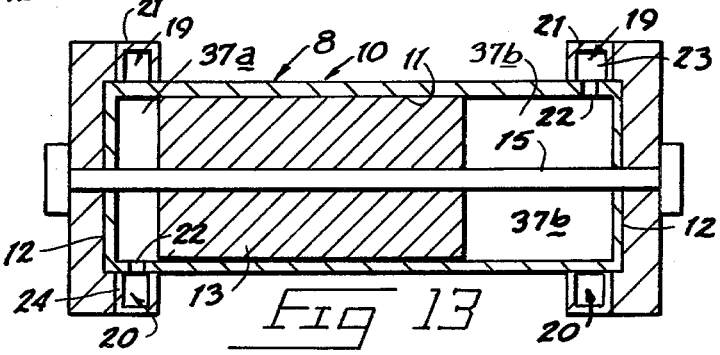
Fig 13
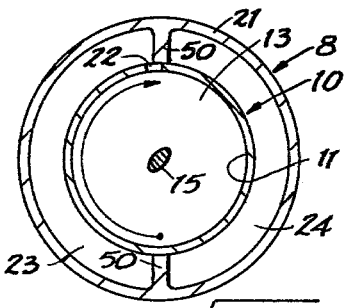
Fig 14
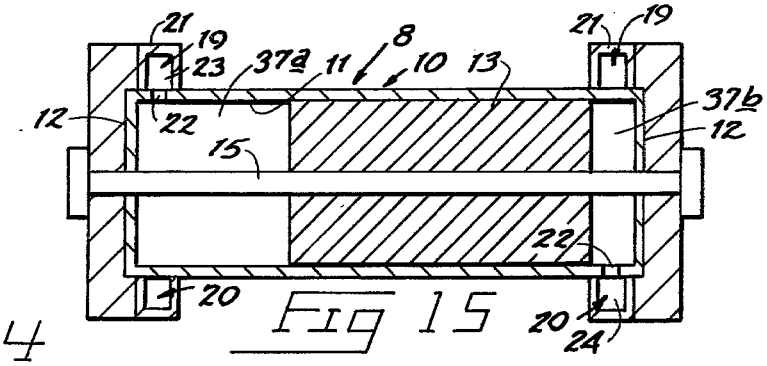
Fig 15

Fig 17
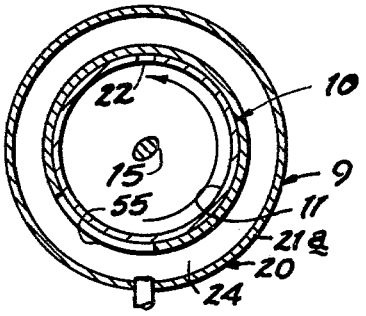
Fig 16
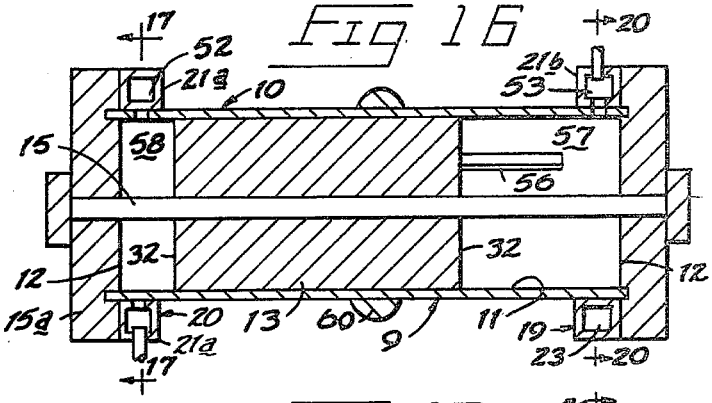
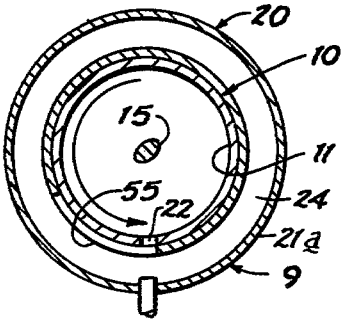
Fig 18
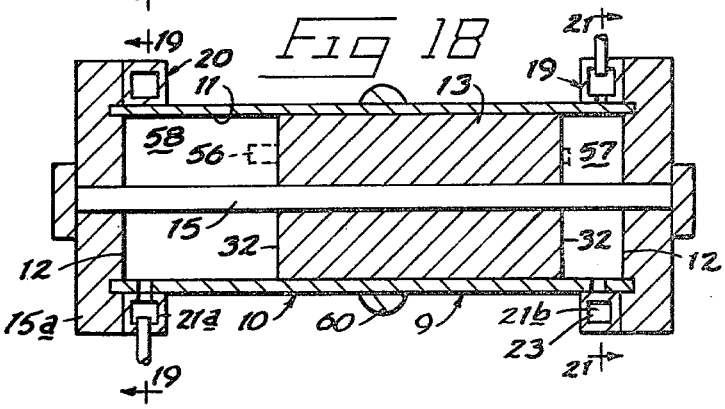
Fig 19
Fig 21
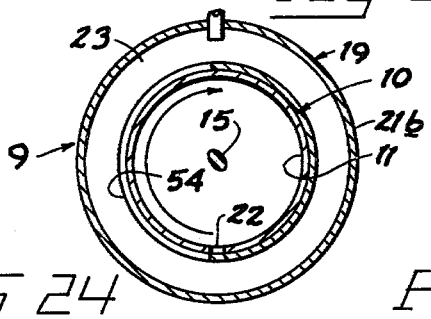
Fig 20
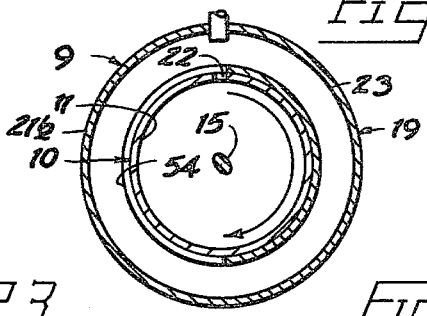
Fig 24
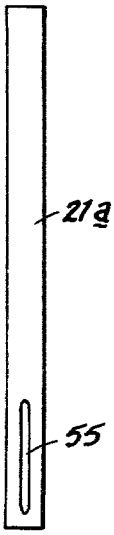
Fig 23
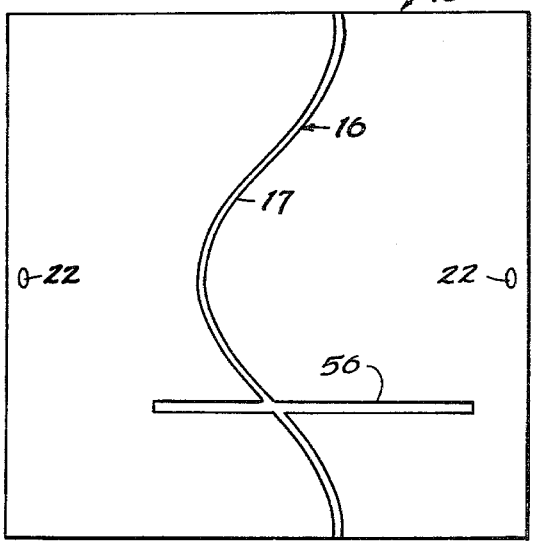
Fig 22
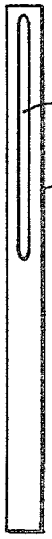

EXPANSIBLE CHAMBER DEVICE

BACKGROUND OF THE INVENTION

The present device relates broadly to the field of expansible chamber devices and more particularly to such devices utilizing reciprocating pistons.

The efficiency of conventional piston type expansion chamber devices is typically low. Energy is wasted in such devices in causing reciprocation of the piston, valving and in transmission of power developed (especially in internal combustion engines). Two and four cycle internal combustion reciprocating engines waste much energy for purposes of valving. Whether tappet or rotary valves are used, energy developed by the engine is sacrificed for their operation. In the typical internal combustion four cycle engine, a cam shaft is driven by the central power take-off crankshaft. Elongated push rods ride along the lobes of the cam and operate spring biased rocker arms. Valve stems are operated from the rocker arms. It is obvious that there is a considerable friction loss in such an arrangement. There is also difficulty in achieving and maintaining proper timing of these valve arrangements in relation to the reciprocation of the pistons.

More efficiency is realized with two cycle engines which often make use of rotary type valving or specially designed scavenging ports formed through the cylinder wall. These of course do away with much of the friction loss found with the more complex valving arrangements but also make sacrifices themselves in proper charging of the chambers and exhaust.

The necessary transmission of power from internal combustion engines and reciprocating piston pumps is another area of energy loss or inefficiency. Several connections are typically made through wrist pins, connecting rods, crankshafts, and finally to a power transmission. Friction is a considerable factor with such multiple connections.

A further problem with both pumps and reciprocating engines is bulk size and weight. An engine should be designed with high power output to weight. Conventional reciprocating piston engines do not make full use of their pistons and cylinders. This is especially true since only one side of the piston is typically used in engines having a single expandable chamber per cylinder. The weight is therefore considerable and has not to this time been effectively reduced. The size and weight of such devices create further difficulties in mounting and providing adequate space within their associated framework and carriage. Heavier members must be provided to support the engine or pump, therefore causing further weight disadvantages and waste of materials.

From the above problems it can be seen that it is desirable to obtain some form of expansible chamber device that will operate efficiently, producing an output that is high relative to its weight.

BRIEF DESCRIPTION OF THE DRAWINGS

FIG. 1 is a longitudinal cross-sectional pictorial view of a four-cycle engine embodying the principal features of the present invention;

FIG. 2 is a horizontal cross-section taken through the engine of FIG. 1 along line 2—2 thereon;

FIG. 3 is a reduced operational diagrammatic view similar to FIG. 2 only showing operational positions of the elements illustrated therein;

FIG. 4 is a sectional diagrammatic sectional view of the four cycle engine illustrating a first portion of the elements therein corresponding to the diagrammatic view of FIG. 3;

FIG. 5 is a view similar to FIG. 3 only showing another operational relationship of the elements illustrated therein;

FIG. 6 is a diagrammatic sectional view showing a second operative position corresponding to FIG. 5;

FIG. 7 is a view similar to FIG. 5 only showing a different operational relationship of the elements therein;

FIG. 8 is a diagrammatic sectional view housing a third operative position corresponding to FIG. 7;

FIG. 9 is an operational view similar to FIG. 7 only showing a different relationship of the elements therein;

FIG. 10 is a diagrammatic sectional view showing a fourth operative position coresponding to FIG. 9;

FIG. 11 is a flat development of the cylinder block illustrated in FIGS. 5 through 10;

FIG. 12 is a diagrammatic cross-sectional view through a pump or fluidic motor version of my invention;

FIG. 13 is a diagrammatic longitudinal section of the device illustrated in FIG. 12;

FIG. 14 is a view similar to FIG. 12 only showing a different operational relationship of the elements therein;

FIG. 15 is a view similar to FIG. 13 only showing a different operational relationship of the elements therein;

FIG. 16 is a diagrammatic longitudinal section of a two cycle engine embodiment of the present invention;

FIG. 17 is a sectioned view taken along line 17—17 in FIG. 16;

FIG. 18 is a view similar to FIG. 16 only showing a different operational relationship of the elements therein;

FIG. 19 is a cross-sectional view taken substantially along line 19—19 in FIG. 18;

FIG. 20 is a cross-sectional view taken substantially along line 20—20 in FIG. 16;

FIG. 21 is a cross-sectional view taken substantially along line 21—21 in FIG. 18;

FIG. 22 is a flat development of an intake collar of the engine shown in FIGS. 16 through 21;

FIG. 23 is a flat developed view of the cylinder block of the engine illustrated in FIGS. 16 through 21; and FIG. 24 is a flat development of an exhaust collar for the engine shown in FIGS. 16 through 24.

DETAILED DESCRIPTION OF A PREFERRED EMBODIMENT

Three embodiments of the invention are illustrated in the accompanying drawings. FIGS. 1 through 11 deal with a four cycle engine. FIGS. 12 through 15 diagrammatically illustrate a pump or motor. FIGS. 17 through 24 diagrammatically illustrate a two cycle engine. The four cycle engine is designated by the reference character 7. The pump or motor is illustrated at 8, and the two cycle engine is shown basically at 9.

Before discussing any of the embodiments in particular detail, a description will be given of the elements that are generic to all three.

All embodiments of the invention include a cylinder block 10 that defines an elongated cylindrical bore 11 centered along an axis 14. The bore includes opposed closed ends 12. One or more pistons 13 are slidably received within the bore 11 to move along the bore axis 14.

The piston 13 and cylinder block 10 are operatively connected through means of an elongated rod 15. The rod 15 is held rotationally stationary relative to the piston and block 10 through connection to a stationary base member 15*a* that provides general support for the entire device. The rod 15 can assume two basic relationships with the associated piston. First, the rod can be fixed to the piston so that it will slide axially within the bore 11. The four cycle engine in FIGS. 8 and 10 illustrates this principle. Also, the piston and rod may slide relative to one another. For example, FIGS. 13 and 15 show the piston 13 sliding axially along the length of a fixed, stationary rod 15. In either situation, rotation of the rod is prevented by the base member 15*a* and rotation of the piston on bore axis 14 is prevented by the rod 15. The illustrated rod 15 is eliptical in cross section and passes through complementary openings in the base or piston. Since the rod is not of circular cross section, it cannot rotate about its axis unless the slidably attached piston or base member also rotates.

The cylinder block 10, however, is allowed to rotate on its axis 14 on appropriate bearings in the base members 15*a*.

A motion transmitting means 16 is connected between the piston and cylinder block. It establishes a direct driving relationship between the two such that reciprocation of the piston causes rotation of the block, or so that rotation of the cylinder block causes reciprocation of the piston. It is preferred that means 16 be in the form of a sinusoidal cam member 17 and an interfitting follower member(s) 18. The cam member preferably takes the form of a sinusoidal groove formed in the cylinder wall while the follower member(s) is located at the longitudinal center of the piston. This relationship may be reversed, however, with the sinusoidal groove formed in the piston and the follower(s) mounted to the cylinder block.

Twice the amplitude of the sinusoidal cam member 17 determines the length of the piston stroke. To prevent blow-by through the cam groove between the opposed expansion chambers found between the ends of the piston and cylinder bore ends 12, the axial dimension (length) of the piston is to be slightly greater than four times the amplitude of the sinusoidal cam member 17.

An intake means 19 and an exhaust means 20 are provided at opposite ends of the cylinder. The intake means is associated with the cylinder block to admit fluid into the bore 11 in response to reciprocating motion of the piston therein. It is operative in response to rotation of the cylinder block relative to the piston. The exhaust means 20 is also associated with the cylinder block in the same manner as the intake means. It is utilized for directing a fluid out of the bore in response to reciprocating motion of the piston therein. It is also operative in response to rotation of the cylinder block relative to the piston.

Both intake means 19 and exhaust means 20 include annular porting means such as collars 21 which are slidably mounted to the cylinder block and are held stationary relative to the supporting base. This may be accomplished by affixing the porting collars to adjacent base members 15*a*. The intake and exhaust means also include ports 22 that are formed through the cylinder block. The ports 22 rotate with the block in circular paths radially inward of the porting collars 21. The circular paths of the ports 22 are circumscribed by the porting collars.

The intake means 19 includes a fluid intake chamber 23 formed integrally within one of the porting collars 21. The fluid intake chamber 23 may receive fluid from an appropriate source and dispense it through the adjacent port 22 into the associated portion of the bore 11.

The exhaust means 20 includes a fluid exhaust chamber 24 that is in periodical communication with the bore 11 through an adjacent port 22. As shown in FIGS. 7 and 9, the intake and exhaust means 19 and 20 may be combined in one porting collar 21 with the fluid intake chamber 23 situated adjacent to the fluid exhaust chamber 24. FIGS. 12 and 14 illustrate different versions of the intake and exhaust chambers 23 and 24 for use with the pump or fluidic motor configuration.

FIGS. 17, 19, 20, and 21 show porting collars 21 having an intake chamber 23 in one collar with an exhaust chamber 24 in a remote collar 21. This form of intake and exhaust means 19 and 20 is associated with the two cycle engine version of my invention.

It should be noted that the intake means 19 generically includes any apparatus for allowing a fluid to enter into the bore 11 in response to reciprocation of the piston 13 therein. For example, the fluid intake chamber 23 of the four cycle engine version of my invention may be associated with a carburation system, turbo charger, or fuel and air injection mechanisms by which a mixture of air and fuel is introduced into the bore 11. The pump version requires only that some form of delivery device such as a pipe be openly connected to the fluid intake chamber with the remaining end submerged within the fluid to be pumped. Also, in the two cycle engine version, the intake means may be associated with standard carburation, injection, turbo charging mechansims or specially designed mechanisms adapted particularly for use with the present device in association with its rotating cylinder 10.

A cooling system 28 and lubricating system 29 may be provided for any or all of the described versions of my invention. The cooling system 28 and lubricating system 29 are diagrammatically illustrated in FIG. 1. It is noted that the systems 28 and 29 are diagrammatically illustrated and that other systems may be efficiently utilized in conjunction with the present device. The cooling system 28 may be of the air, water, or oil cooling varieties whereby the areas of the cylinder adjacent opposed ends of the bore 11 are subjected to cooling fluid about the entire periphery of the block 10. Similarly, a lubricating end system 29 may circumscribe the rotatable cylinder block and make use of the cylinder rotation for pumping oil to the various points requiring lubrication throughout the engine or pump.

The above described elements are generic to the three forms of the invention which will be described in greater detail below. Reference numerals utilized in describing the generic elements will also be utilized where necessary in describing the separate embodiments.

FOUR CYCLE ENGINE

The four cycle engine embodiment of the present invention may include two interconnected coaxial cylinders 10. Three base members 15*a* are situated at opposite ends of the two coaxial cylinder blocks to rotatably journal the ends of the blocks. Two pistons 13 are also utilized, one for each of the bores 11. The pistons 13 are interconnected rigidly by an eliptical rod 15. This rod is forced through a complementary eliptical opening 15*b* formed in the central base member. Therefore, the pistons are allowed relatively free axial motion but are prevented from rotating about axis 14.

Each piston includes a pair of opposed head faces 32 that face opposite ends of the respective bores 11. Slightly axially inward of the faces 32 are compression rings 33. Oil rings and additional compression rings may also be supplied depending on the compression requirements of the engine. The rings are spaced apart axially by a distance slightly greater than four times the amplitude of the sinusoidal cam member 17 (see FIGS. 4, 6, 8, 10 and 11). This assures that there is no "blowby" along the sinusoidal groove comprising the cam member 17 from one end of the bore 11 to the opposite end. The sinusoidal cam 17 is thereby isolated between the rings 33.

The four cycle version of my invention includes ignition means 31 for sequentially igniting successive charges of fuel and air that is delivered into the bore 11 through the intake means 19.

The ignition means may be in the form of a spark plug, glow plug, or it may be integrated with the piston, cylinder, and intake means to produce spontaneous combustion of diesel fuel without a special ignitor. For the purpose of this description, however, the version of the engine shown includes a spark plug 34 situated within an ignition chamber 35. These chambers oppose the intake and exhaust chambers 23 and 24 of each porting collar 21. This arrangement may facilitate utilization of a "stratified charge" design in which a rich fuel mixture is injected into the chamber 35 in timed relation to rotation of the cylinder block 10 to bring the associated port 22 into open communication with the chamber 35. In this situation, a lean air and fuel mixture would be delivered from the fluid intake chamber 23 prior to rotation of the port 22 to the ignition chamber 35.

A fuel supply means 36 may be provided in the form of fuel injectors 36*a* or standard carburation devices. Turbo charging may also be provided.

The piston faces 32 define, along with the bore 11 and closed ends 12, four independent working chambers. These chambers are basically identical but for the purposes of description, will be labeled separately as chambers 37, 38, 39, and 40. A porting collar 21 is provided for each chamber 37 through 40 and is located adjacent the base 15*a* beyond the extremities of the stroke for the associated piston.

The porting collars 21 are in axial alignment along the full length of the engine. The successive ports 22, however, are angularly spaced in 90° increments (as may be noted in FIG. 11) about the cylinder block 10. An efficient operational cycle of the engines is thereby accomplished by alternating the phases of the four stroke concept such that each chamber is performing a different function at any selected interval during the stroke. FIGS. 3 through 10 illustrate the relationship of the cylinder block and pistons through a complete operational cycle.

FIGS. 3 and 4 may be designated as the starting and ending position for an operational cycle. The pistons have moved downwardly producing an expansion of chamber 37, which, because of the angular position of port 22 in communication with the associated intake chamber 23, becomes an intake stroke. The opposite piston face 32 associated with chamber 38 has moved downwardly to compress the volume of chamber 38. Here the port 22 associated with chamber 38 is in open communication with the exhaust chamber 24 so the compressed gases will be exhausted through the porting collar 21 in an exhaust stroke. Moving downwardly beyond the intermediate base section 15*a*, chamber 39 is in an expanded condition with the piston performing a power stroke. The port 22 here is in open communication with the ignition chamber 35. At the opposite end of this piston is chamber 40 which, like chamber 38, is compressed. However, the port 22 associated with chamber 40 is not in open communication with any of the chambers in the associated porting collar. Instead, it is sealed from communication with any of the chambers as it moves between the intake port and the ignition chamber 35.

The power produced during the combustion within chamber 39 causes the pistons 13 to move axially in the downward direction. This powered downward movement causes the intake and exhaust and compression functions of the remaining chambers 37, 38 and 40. It also causes corresponding rotational movement of the cylinder block 10 due to the motion transmitting means 16. Axial motion of the followers 18 against the sinusoidal cam members 17 produce torsional movement of the cylinder blocks 10. This translation of axial motion to rotational motion continues throughout the cycling of the engine due to the relationship of the cam 17 and followers 18.

FIGS. 5 and 6 show the pistons moving upward following the stroke illustrated by FIGS. 3 and 4. Here, chamber 37 has been reduced in volume by the upward stroke of the piston to compress the fuel and air mixture received during the previous intake stroke. This compression stroke occurs as the associated port 22 moves between the intake chamber and ignition chamber during rotation of the cylinder block. Chamber 38 is simultaneously expanding during an intake stroke as its port 22 is now in open communication with the associated fluid intake chamber 23. Chamber 39 has been compressed and the fluid therein has been expelled through its associated port 22 into its adjacent fluid exhaust chamber 24. The chamber causing primary motion of the pistons in the upward direction is chamber 40 which is experiencing expansion due to combustion within its confines. Its port 22 has come into open communication with the ignition chamber 35.

The third stroke of the engine is diagrammatically illustrated in FIGS. 7 and 8. Here, the downward stroke of pistons 13 is caused by combustion within chamber 37 as its port 22 comes into communication with the ignition chamber 35. Downward stroke of the pistons causes chamber 38 to compress the fluid received during its previous intake stroke. It also causes chamber 39 to expand drawing fluid inwardly through open communication of its port 22 with its intake chamber 23. Previously burned gases in chamber 40 are exhausted through its port 22 and into the adjacent fluid exhaust chamber 24.

On the final stroke which is illustrated by FIGS. 9 and 10, chamber 37 is completing its cycle with an exhaust stroke. Its port 22 has come into alignment with the exhaust chamber 24 as the piston moves upwardly to force the burned gases outwardly of the chamber. Simultaneously, chamber 38 has expanded due to combustion of the previously compressed gases as its port 22 comes into communication with its ignition chamber 35. Compression is occurring within chamber 39 as its port 22 moves between its associated intake chamber 23 and ignition chamber 35. Chamber 40 simultaneously expands during an intake stroke where the associated port 22 is in open communication with the adjacent fluid intake chamber 23.

It may be understood that power is produced evenly and continuously as one of the four chambers is expanding due to combustion at any selected point in the cycle. This power is transmitted, as described, from axial motion of the pistons to rotational motion of the cylinder blocks 10.

A power takeoff means 43 may be provided interconnecting the cylinder blocks to transmit the power produced within the expansible chambers to any desired area remote from the engine. The example illustrated in FIG. 1 shows a pair of gears 44 affixed to the cylinders. Pinions 45 mesh with the gears 44 and are themselves attached to a freely rotatable shaft 46 that is journalled by base 15*a*. It is noted that this is merely exemplary of a power takeoff for the engine and that others may be readily devised.

The power produced by the engine is, of course, controlled at least partially by the fuel and air volume and mixture received within the expansible chambers. Transmission of the power produced, however, can have an effect through the physical characteristics of the sinusoidal cam member and follower 18. It is preferred, for maximum efficiency, that the thrust angle or slope of the sinusoidal groove be approximately 45°. This angle would produce a one-to-one ratio of axial force input and torsional force output. The power output of the rotating cylinder block and its associated rpm in relation to reciprocation of the pistons may be varied by changing the slope of the sinusoidal cam. If the slope is increased, power is increased and rpm is reduced. If the slope is decreased, power is reduced and rpm is increased.

The preferred 45° slope for the sinusoidal cam dictates a stroke length that is equal to one fourth of the cylinder circumference in order to produce four strokes per revolution of the associated cylinder block 10. The bore, of course, is equal in diameter to the cylinder circumference divided by pi. The total engine displacement is four times the volume of each chamber or applying the bore and stroke relation, a total displacement of the stroke times the bore times the circumference. The significance of this relationship is that the length in diameter of the engine will always have a constant ratio regardless of size. Of course, if the slope of the sinusoidal groove is varied, the corresponding circumference and stroke must correspondingly be varied in order to maintain the four stroke per cylinder revolution relationship.

An obvious advantage of the above described engine is that there are few moving parts, namely the pistons and cylinders. Such a significant reduction of moving parts can substantially reduce manufacturing and assembly costs and can also significantly reduce the costs of maintenance and repair.

The opposed piston arrangement creates four combustion chambers arranged within a single cylinder. The cylinder serves as a chamber housing, replacement element serving the usual functions of a power takeoff. Conventional engine blocks, crankshafts, cam shafts, fly wheels, rocker arms, and other elements relating to standard valve assemblies are eliminated. Consequently, the present engine should be capable of a greater power to weight ratio than engines now in use.

As briefly discussed above, the cylinder does away entirely with complicated valve trains presently utilized in internal combustion engines. The valving is accomplished through the ports 22 that are spaced apart in relation to direction of rotation for the cylinder and reciprocation of the pistons. There is no need for a spark plug (a glow plug or spontaneous combustion under high compression can accomplish the same purpose) or a distributor. The cylinder openings 22 determine when and for how long the compressed intake fluid will be exposed to ignition. Such ignition can be a continuous arc powered by a magneto or can be provided by bleeding combustion from one chamber to another through an appropriate channel or ducting (not shown). The engine as also discussed above, lends itself easily to the stratified charge principle. For example, a lean mix of 18 to 1 could be provided during the intake cycle, with a rich 6-1 mix being injected across the arc or within the ignition chamber 35 to initiate the combustion cycle. The initially burning charge will ignite the lean mixture so increased fuel efficiency and reduced emissions may result.

The engine design readily lends itself to utilization of more than one engine in side to side clusters or in end-to-end tandem arrangements where power and spatial demands vary. Thus, it is to be understood that more than the illustrated cylinders may be connected in series along a single axis for the purpose of producing additional power, or several of the engines as shown may be connected in lateral relationship to a single power output shaft.

PUMP-FLUIDIC MOTOR

As briefly discussed above, the present invention may be incorporated in the form of a pump or fluidic motor. An arrangement of the generic elements to perform this function is shown in FIGS. 12 through 15.

Both versions, the pump or the fluidic motor, involve the same working elements. The primary distinction between the version illustrated in FIGS. 12 through 15 and the two and four cycle engine versions is within the intake means 19 and exhaust means 20. Here, the annular porting collars 21 are divided by semicircular intake chambers 23 spaced directly opposite to exhaust chambers 24. Chambers 23 and 24 each extend substantially halfway about the circular periphery of the associated cylinder block 10, being divided by appropriate seals 50 at opposite ends thereof.

A single piston may be utilized with the sinusoidal cam member being arranged substantially as illustrated for the two cycle engine in FIG. 23. Here, two strokes of the piston will produce a full rotation of the cylinder block, or one rotation of the cylinder block will produce two strokes of the piston.

The ports 22 are substantially diametrically opposed in the pump-motor configuration. When the piston is moving in one direction, one port 22 is in open communication with an intake chamber 23 and the remaining port 22 is in open communication with an exhaust chamber 24.

The cylinder block 10 may be provided with a power takeoff similar to that described for the four cycle engine which can also be utilized for transmitting power for powered rotation of the cylinder block, depending upon the use for the pump-motor.

When the device is to be utilized as a pump, the cylinder block 10 is forceably rotated through an appropriate drive mechanism. Rotation of the cylinder block 10 causes corresponding reciprocating movement of the piston within the bore due to the relationship of the sinusoidal cam member 17 and follower 18. Rotation in the direction illustrated in FIG. 12 may bring the piston to the position illustrated in FIG. 13. Here, a chamber 37*a* has been compressed while an opposite chamber 37*b* is expanded. The compressed chamber 37*a* is opened to an associated exhaust chamber 24 of the porting collar 21 through its port 22. The expanding chamber 37*b* is in open communication with its intake chamber 23 through its port 22.

As chamber 37*b* expands, fluid will be drawn into the bore through port 22. As chamber 37*a* is reduced in volume, the fluid contained therein is forced outwardly through port 22 and into the exhaust chamber 24 where it may be received and routed for whatever purpose is required.

Continued rotation of the cylinder block in the direction indicated in 14 causes reverse reciprocation of the piston to the position illustrated in FIG. 15. Here, the chamber 37*a* has expanded while its associated port 22 is moved into open communication with the intake chamber 23 of its associated porting collar 21. The remaining chamber 37*b* has been reduced in volume by the reciprocating piston as its port 22 moves into open communication with the exhaust chamber 24 of its porting collar 21. Fluid is therefore received in chamber 37*a* and discharged from chamber 37*b*. The two chambers 37*a*, 37*b* and associated porting collars may be connected in series with the exhaust chamber of one connected to the intake chamber of the other or each may function separately on the same or different fluid sources.

If the device is to be utilized as a fluidic motor, a fluid is supplied under pressure to the intake chambers 23. One of the ports 22 will be open to an adjacent intake chamber and the pressurized fluid will be allowed to enter the adjacent expansible chamber. The pressurized fluid will cause movement of the piston axially along the rod 15 and therefore cause corresponding rotation of the cylinder block 10. The pressurized fluid is exhausted as the port 22 rotates with the cylinder block into open communication with the exhaust chamber 24. As this happens, the remaining port 22 at the opposite end of the cylinder will come into open communication with the intake chamber 23. This will allow entry of pressurized fluid along the opposite side of the piston to cause reverse axial motion of the piston, causing further rotation of the housing and expulsion of the fluid within the opposite chamber through its associated exhaust chamber 24. The cycle is repeated continuously as long as pressurized fluid is received and directed through the present device.

It should be noted that the pump or fluidic motor can be operated with any flowable material. Therefore, a gas may be pumped through the device or it may be the pressurized medium for which to operate the device as a fluidic motor. Similarly, a noncompressible liquid can either be pumped or utilized as a motive force for the fluidic motor.

TWO CYCLE ENGINE

FIGS. 16 through 24 diagrammatically illustrate a two cycle engine version of the present expansible chamber device. The two cycle engine version is somewhat similar to the pump and fluidic motor version described above except for variations in porting and with the additional provision of a blow-by groove fromed within the wall of the cylinder.

The two cycle engine includes independent porting collars each having a single function. A porting collar 21*a* at one end of the cylinder is utilized solely for the purpose of receiving and collecting spent exhaust gases from the adjacent chamber. At the opposite end of the cylinder block is an intake collar 21*b*. The intake chamber 23 extends entirely about the circumference of collar 21*b* and the exhaust chamber 24 extends entirely about the circumference of exhaust collar 21*a*.

FIGS. 22 and 24 shows flat developments of the two collars 21*a* and 21*b*. The intake collar 21*b* includes an elongated opening 54 which is axially situated in a circular path of an associated port 22 formed through the cylinder block 10. The port 22 may therefore remain in open contact with the intake chamber for approximately 180° rotation of the cylinder block. The remainder of the collar remains in sealed sliding engagement with the cylinder block to seal the port 22 from the intake chamber for a portion of the rotational path of port 22. The exhaust collar 21*a* is shown in FIG. 24. It includes an opening 55 extending along its length to be situated within the circular path of the remaining port 22. The opening 55 enables open communication between the exhaust chamber 24 and the associated expansible chamber.

The expansible chambers adjacent opposite ends of the piston 13 represent an intake chamber 57 and a work chamber 58. The two chambers 57 and 58 are periodically interconnected through an axial blow-by groove 56. The groove 56 extends between the two chambers and is successively covered and exposed due to the reciprocating motion of the piston 13. FIG. 16 shows the piston at one position where blow-by groove 56 is sealed in relation to the work chamber 58. FIG. 18 shows open communication between the blow-by groove 56 (dashed lines) and both chambers 57 and 58.

The axial blow-by groove is illustrated in FIGS. 16, 18 and 23. FIG. 23 illustrates the interconnection of the blow-by groove 56 with the sinusoidal cam 17 which is formed as a groove in the cylinder wall. The intersection of the two grooves is advantageous in that lubricating oil may be distributed to the sinusoidal groove through the axial blow-by groove 58 as air and fuel are moved from intake chamber 57 to work chamber 58.

Momentum of a weighted fly wheel or collar 60 will serve to rotate the cylinder 10 once operation is initiated. The initial rotational motion serves to drive the piston to compress a mixture of fuel and air in the work chamber while a new fuel charge is drawn through the intake chamber 23. Combustion (caused by a spark plug, glow plug or by spontaneous combustion) forces the piston back, and, at the bottom of the combustion stroke, the port 22 associated with work chamber 58 will open and allow exhaust to vent through the exhaust chamber 24. Almost simultaneously, a new fuel charge is forced through the blow-by groove 56 from chamber 57 into chamber 58. Momentum of the weighted fly wheel carries through compression and the cycle is repeated.

It is pointed out that a pair of the two cycle engines may be joined at their intake chambers in a manner somewhat similar to the four cycle version illustrated in FIG. 1. Two engines joined at their intake collars will have more than twice the power output of the single unit illustrated because the fly wheel can be eliminated and the combustion interval or time between power strokes would be halved.

Operation of the two cycle version of may invention is initiated as the engine is started by rotating the cylinder block 10 in the direction indicated by the arrow in FIG. 17. This rotation is carried by momentum through provision of the weighted fly wheel 60. Rotation of the cylinder causes corresponding reciprocating motion of the piston 13. The rotation of cylinder 10 in relation to reciprocation of piston 13 is such that two strokes of the piston will be made for each rotational cycle of the cylinder.

As the piston moves toward the exhaust collar, the port 22 associated with the exhaust collar will move correspondingly about the adjacent peripheral surface of the exhaust collar 21*a*. At the other end of the block 10, the remaining port 22 moves about the intake chamber 23 in open communication with the intake opening 54 formed therethrough. An air and fuel mixture is being compressed by the piston as it moves toward the exhaust collar since there is no communication between opening 22 and the exhaust chamber. Compression is continued until the fuel and air mixture is ignited.

The return stroke of the piston due to combustion within working chamber 58 causes further rotation of the cylinder block 10. This further rotation brings the port 22 into open communication with the exhaust opening 55 as shown in FIG. 19. The exhaust opening will remain in open contact with the port 22 as the piston continues to move toward the intake chamber. However, when the piston begins its return compression stroke, the exhaust port is closed.

Simultaneously with the exhaust elimination is the reception of a fresh fuel-air charge within the working chamber. This is accomplished as the piston displaces a previously received air and fuel charge from the intake chamber 57 to the working chamber 58. The relationship of the exhaust opening 55 and axial position of the blow-by groove 56 is arranged so that no raw fuel and air mixture may be ignited by the previously burned gases.

As momentum carries the piston through the compression cycle, compressing the newly received charge of fuel and air within chamber 58, the intake chamber 57 is simultaneously receiving a fresh charge of the mixture. This charge is received through opening 22 in association with the intake opening 54 of the intake collar 21*b*. A full charge is received as the piston reaches the end of its compression stroke. Then, on the downward or power stroke, the port moves into sealed relationship with the intake collar and the fresh charge of fuel and air is displaced by the piston and caused to move forcefully through the axial blow-by groove 56 and into the working chamber. This cycle is repeated so long as the engine continues to run.

It is pointed out that the above description, including the generic elements and the various specific embodiments thereof are merely exemplary and that various modifications may be made thereto. Such modifications are intended to be included within the scope of my invention which is set forth only by the following claims.

What I claim is:

1. An expansible chamber device, comprising:

a stationary base;

a cylinder block;

an elongated enclosed bore formed within the cylinder block along a central axis;

means mounting said block to said base for rotation of the block relative to the base about said axis;

a piston slidably received within the bore for coaxial reciprocating motion therein, along said axis forming expansible chambers within the bore at opposite ends thereof;

rod means interconnecting said piston and base for preventing rotational movement of the piston about the axis relative to the base;

motion transmitting means connecting the cylinder block and piston for directly relating rotational movement of the cylinder block about the axis and reciprocal movement of the piston along said axis through a defined stroke;

intake means associated with said cylinder block operative in response to rotation of the cylinder block relative to the base for sequentially admitting a fluid into an expansible chamber within the bore; and exhaust means associated with said cylinder block operative in response to rotation of the cylinder block relative to the base for sequentially directing a fluid out of an expansible chamber within the bore.

2. The device as set out by claim 1 wherein said motion transmitting means is comprised of:

a continuous annular sinusoidal cam member;

a follower member;

wherein said cam and follower members operatively engage one another with one member being operatively mounted to said piston and the remaining member being disposed on said cylinder block.

3. The device as set out by claim 2 wherein the piston includes a length dimension between ends at least equal to four times the amplitude of said continuous annular sinusoidal cam member.

4. The device as set out by claim 2 wherein said follower member is mounted to said piston.

5. The device as defined by claim 1 wherein said intake means and said exhaust means include:

porting means slidably mounted to said cylinder block and operatively fixed to the base;

ports opening into said bore and formed integrally with and through said cylinder block to communicate openly with said porting means and for movement with said cylinder block relative to said porting means in circular paths about the axis of said bore;

said porting means each having fluid intake and exhaust chambers therein with each chamber being formed partially about the axis of said bore in the path of a port for cyclicly coming into open communication with said expansible chambers through said ports.

6. The device as defined by claim 2 wherein said exhaust means and said intake means include porting means slidably mounted to the cylinder block;

wherein said porting means and said rod means are relatively stationary about the bore axis with respect to the base, whereby reciprocating motion of said piston will cause corresponding revolving motion of said cylinder block with respect to the base about the axis of said bore.

7. The device as defined by claim 6 wherein the slope of the cam member is 45°.

8. The device as defined by claim 1 wherein the intake and exhaust means are comprised of:

a pair of porting means centered on the bore axis and operatively fixed to said base and slidably mounted to said cylinder block;

ports formed at each end of said bore through the cylinder block to openly communicate with said bore and with the porting means;

said porting means each including (a) a fluid receiving chamber therein extending angularly about the axis of said bore for approximately 180°, and (b) a fluid exhaust chamber extending about the bore axis from opposite ends of the fluid receiving chamber the remaining approximate 180°, said fluid receiving chambers being sealed with respect to one another;

wherein said motion transmitting means, porting means and ports are arranged such that as the piston moves away from one port, that one port is positioned to openly join the adjacent expansible chamber with the fluid receiving chamber and the remaining port at the opposite end of said bore is positioned to openly join its adjacent expansible chamber with the fluid exhaust chamber.

9. The device as defined by claim 2 wherein said sinusoidal cam is arranged about the axis in a configuration to produce movement of said piston in four reciprocating strokes for each revolution of said cylinder block relative to said piston.

10. The device as defined by claim 9 wherein said intake and exhaust means are comprised of a pair of porting means, one for each expansible chamber, operatively fixed to said base against rotation about said bore axis relative to said cylinder block;

wherein a port for each expansible chamber is formed through said cylinder block and openly communicating with said expansible chambers and moveable with the cylinder block in circular paths about the axis;

wherein an intake chamber is formed in each porting means in the path of one of said ports for cyclical open communication with its adjacent expansible chamber as said piston is moved along an intake reciprocating stroke;

wherein an exhaust chamber is formed in each porting means adjacent said intake chamber and in the path of one of said ports for sequential open communication with its adjacent expansible chamber as said piston is moved along an exhaust reciprocating stroke.

11. The device as defined by claim 2 wherein said sinusoidal cam is arranged about the axis in a configuration to produce movement of said piston in two reciprocating strokes for each revolution of said cylinder block relative to said piston.

12. The device as defined by claim 1 wherein the intake means is situated adjacent one end of the bore and the exhaust means is situated adjacent the opposite end of the bore and wherein the intake means includes blow-by duct means longitudinally spanning a portion of the piston stroke for cyclically openly connecting the expansible chambers in response to reciprocation of the piston toward the intake means and for being sealed by the piston as it moves toward the exhaust means.

13. The device as defined by claim 12 wherein said motion transmitting means is comprised of:

a continuous annular sinusoidal cam member;

a follower member;

wherein said cam and follower members operatively engage one another with one member being operatively mounted to said piston and the remaining member being disposed on said cylinder block.

14. The device as defined by claim 13 wherein said sinusoidal cam is arranged about the axis in a configuration to produce movement of said piston in four reciprocating strokes for each revolution of said cylinder block relative to said piston.

15. An expansible chamber device, comprising:

a stationary base;

a cylinder block;

an elongated enclosed cylindrical bore formed through the cylinder block along a central axis;

means mounting said block to said bore for rotation of the block relative to the base about said axis;

a piston slidably received within the bore for axial reciprocating motion therein along said axis, forming expansible chambers at opposite bore ends;

rod means slidably mounting the piston to the base for guiding the piston axially in the cylinder block and for preventing rotation of the piston about said axis relative to the base;

motion transmitting means connecting the cylinder block and piston for directly relating rotational movement of the cylinder block about the axis and reciprocal movement of the piston along the axis;

ports formed through the cylinder block, one at each end thereof to communicate openly with the expansible chambers and moveable with the cylinder block in a circular path about the axis;

porting means slidably mounted to the cylinder block at both ends thereof and stationary relative to the base for open cyclic communication with adjacent expansible chambers through the ports;

the porting means including intake and exhaust chambers each extending about the axis in an arc including approximately 180° in the path of the ports;

the ports, porting means, and motion transmitting means being arranged such that (a) as the piston moves in one stroke in a first axial direction fluid is allowed to enter one expansible chamber and simultaneously exit from the other expansible chamber, and (b) as the piston moves in a second stroke in an opposite axial direction fluid is allowed to exit from the one expansible chamber and simultaneously enter into the other expansible chamber.

16. The device as defined by claim 15 wherein the rod means is comprised of a rigid rod of non-circular cross section extending coaxially witin the bore from one end to the other and fixed at one end to the base; and wherein the piston includes an axial opening complementary in cross section to the rod for slidably receiving the rod.

17. The device as defined by claim 15 wherein the motion transmitting means includes a continuous sinusoidal cam member operatively engaged by a follower member, with one of the members being situated on the piston and the other being situated on the cylinder block.

18. The device as defined by claim 17 wherein the sinusoidal cam is formed as a continuous groove in the cylinder block, opening is into the bore and the follower member is centered longitudinally on the piston and is moveably engaged within the groove.

19. The device as defined by claim 15 wherein the intake and exhaust chambers of each porting means are separated by seal members slidably engaged with the cylinder block.

* * * * *